US005845446A

United States Patent [19]

Funaki et al.

[11] Patent Number: 5,845,446

[45] Date of Patent: Dec. 8, 1998

[54] LONGITUDINAL FACING, FACING RETAINERS, AND FACING STRUCTURE HAVING FACING AND FACING RETAINERS

[75] Inventors: Motokatsu Funaki; Noboru Yamasaka; Kazuyuki Nishizawa, all of Fujisawa, Japan

[73] Assignee: Gantan Beauty Industry Co., Ltd., Fujisawa, Japan

[21] Appl. No.: 697,458

[22] Filed: Aug. 23, 1996

[30] Foreign Application Priority Data

| | | | |
|---|---|---|---|
| Aug. 25, 1995 | [JP] | Japan | 7-239074 |
| Aug. 30, 1995 | [JP] | Japan | 7-243972 |
| Nov. 8, 1995 | [JP] | Japan | 7-313686 |
| Mar. 14, 1996 | [JP] | Japan | 8-084494 |

[51] Int. Cl.[6] ..... E04D 3/362

[52] U.S. Cl. ..... 52/461; 52/464; 52/469; 52/520; 52/533; 52/545; 52/547; 52/549; 52/550; 52/551

[58] Field of Search ..... 52/461, 464, 469, 52/520, 533, 545, 547, 549, 550, 551

[56] References Cited

U.S. PATENT DOCUMENTS

| | | | |
|---|---|---|---|
| 2,192,719 | 3/1940 | Tapman | 52/464 |
| 2,907,287 | 10/1959 | Trostle | 52/461 X |
| 3,352,077 | 11/1967 | Slusser | 52/469 |
| 4,388,789 | 6/1983 | Murphy . | |
| 5,152,115 | 10/1992 | Cotter . | |
| 5,187,911 | 2/1993 | Cotter . | |
| 5,423,157 | 6/1995 | Watanabe . | |

FOREIGN PATENT DOCUMENTS

| | | |
|---|---|---|
| 0 634 535 | 1/1995 | European Pat. Off. . |

*Primary Examiner*—Christopher Kent
*Attorney, Agent, or Firm*—Oblon, Spivak, McClelland, Maier & Neustadt, P.C.

[57] ABSTRACT

Longitudinal facing laid on a base between retainers at a prescribed spacing includes a central face plate, an inner riser along right and left edges of the face plate, an outer riser on an outer side of each inner riser, a drain channel formed between the inner and outer risers, an engaging portion at at least one of end and median portions of the outer riser and in resilient engagement with the retainers.

26 Claims, 11 Drawing Sheets

LONGITUDINAL FACING, FACING RETAINERS, AND FACING STRUCTURE HAVING FACING AND FACING RETAINERS

BACKGROUND OF THE INVENTION

1. Field of the Invention

The present invention relates to longitudinal facing including roofing and retainers for the facing, and to a facing structure with the facing and facing retainers.

2. Description of the Prior Art

Many ideas have been proposed aimed at providing roofing offering improved weathering, strength and other properties. JP-A-HEI-2-56464, for example, discloses a roofing structure comprising a roofing sheet having a vertical inner riser (coupled waterproof partition) along the left and right edges and an outer riser (waterproof partition) on the outer side of each inner riser, and a connecting member having a roofing base anchor portion (flat portion) with straight, perpendicular walls at both sides and waterproof leg members. The roofing sheets are laid adjacent to each other in parallel, and fixed in place by the connecting member laid along the sides of the sheets. More specifically, by positioning the perpendicular walls of the connecting member between the risers on the roofing sheets and the waterproof leg members inboard of the roofing sheet risers, roofing sheets are pressed down into place by the connecting members, and a cover is placed over the connecting members.

While this gives the structure double weathering performance with respect to the entry of rain from the side, there are many problems with other aspects of the arrangement. For example, roofing sheets are held in place by fixing connecting members to the roofing base. However, because this fixing of the roofing sheets can only be done after the sheets have been laid, the sheets are just left on the roofing base until they can be attached. This type of roofing is used on medium-to-large-size structures that are larger than private-sector residential structures, and as such is produced in large lengths that range from 10 m to 40 or 50 m or more and are correspondingly heavy. The roofing is therefore laid by large groups of workers, each about 3 m away from the next. If after a sheet of roofing has been placed in a prescribed position on the base, a majority of the workers should move away from the sheet, to work on the next sheet or for some other such reason, the roofing sheet will just be left lying there, unfixed. Because the sheet has such a large area, it can easily be lifted by the wind. This means there is a risk of a sudden gust sending it whirling down from the roof, causing an accident, or knocking over workers. Even if there isn't an accident, if there are not enough workers to handle a sheet of that size, the work schedule can be disrupted by having to spend time for straightening out local deformations, or for aligning the sheet.

An object of the invention is to provide longitudinal facing for the roof or walls of a building that is easy to handle and has good weathering performance.

Another object of the invention is to provide retaining members for easily and securely holding the facing.

Another object of the invention is to provide a facing structure using the facing and retaining members that exhibits an excellent balance between workability, weathering performance, strength, structure and worker safety.

SUMMARY OF THE INVENTION

To attain the above object, the present invention provides facing laid on a base between retainers at a prescribed spacing, the facing comprising a central face plate, an inner riser along right and left edges of the face plate, an outer riser on an outer side of each inner riser, a drain channel formed between the inner and outer risers, an engaging portion at at least one of an end and a median portion of the outer riser and in resilient engagement with the retainers.

The above object is also attained by a retainer for retaining longitudinal facing on a facing base in which the facing comprises a central face plate, an inner riser along right and left edges of the face plate, an outer riser on an outer side of each inner riser, and a drain channel formed between the inner and outer risers, wherein the retainer has an upright portion that engages with an inner riser of the facing.

The object is also attained by a facing structure comprising retainers disposed at a prescribed spacing on a facing base on which a building body or roof sheathing has been laid, sheets of longitudinal facing laid and fixed between adjacent retainers, and capping over spaces between adjacent sheets of facing, wherein the facing comprises a central face plate, an inner riser along right and left edges of the face plate, an outer riser on an outer side of each inner riser, and a drain channel formed between the inner and outer risers, the outer riser of the facing has an engaging portion at at least one of top and median portions thereof, the retainer has an engagement portion, and the engaging and engagement portions are resiliently engaged to maintain the facing toward the facing base.

The object is also attained by a facing structure comprising retainers disposed at a prescribed spacing on a facing base on which a building body or roof sheathing has been laid, sheets of facing laid and fixed between adjacent retainers, and capping over spaces between adjacent sheets of facing, wherein the retainer has an upright portion, the facing comprises a central face plate, an inner riser along right and left edges of the face plate, an outer riser on an outer side of each inner riser, and a drain channel formed between the inner and outer risers, and the upright portion on the retainer locates in a space having a closed topside formed at a reverse side part of the inner riser to control lateral movement of the facing when a load is imposed on the facing.

Further features of the invention, its nature and various advantages will be more apparent from the accompanying drawings and following detailed description of the invention.

BRIEF DESCRIPTION OF THE DRAWINGS

FIG. 2 (*b*) is a perspective view of an upper retainer according to another embodiment;

FIG. 2 (*c*) is a perspective view of a lower retainer in an embodiment of the invention;

FIG. 17 (*b*) is a front view showing another arrangement of the engagement of the capping with an inner riser portion of the facing;

FIG. 17 (*c*) is a front view showing another arrangement of the engagement of the capping with an inner riser portion of the facing;

FIG. 17 (*d*) is a front view showing another arrangement of the engagement of the capping with an inner riser portion of the facing;

DESCRIPTION OF THE PREFERRED EMBODIMENTS

Figure 1:
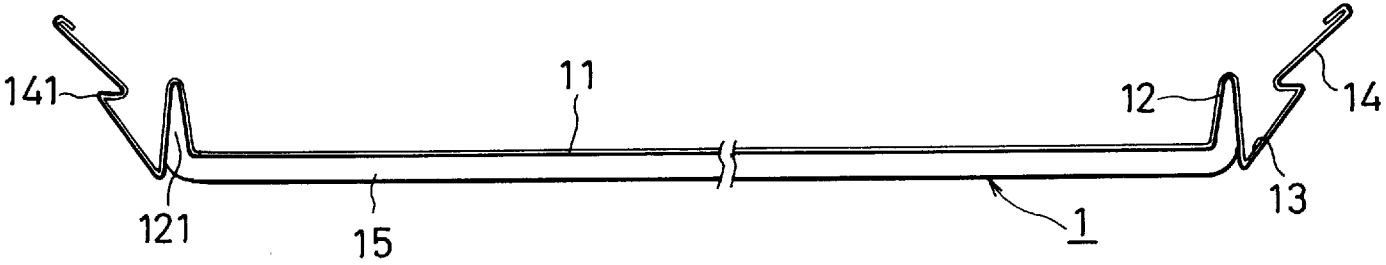
FIG. 1 is a cross-sectional view of longitudinal facing according to an embodiment of the invention.
Figure 2A:
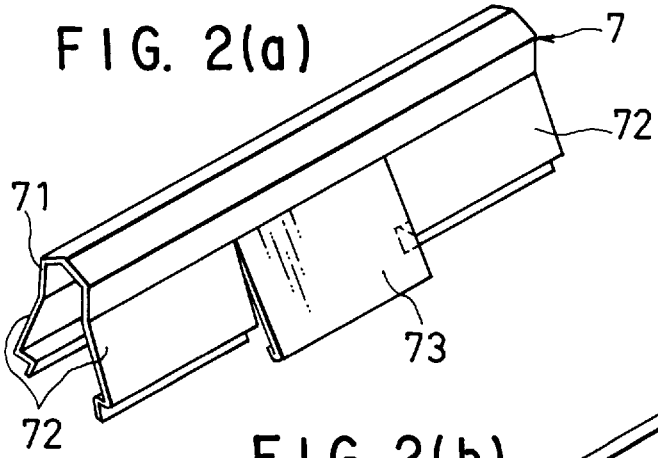
FIG. 2 (*a*) is a perspective view showing the configuration of an upper retainer in the embodiment.
Figure 2B:
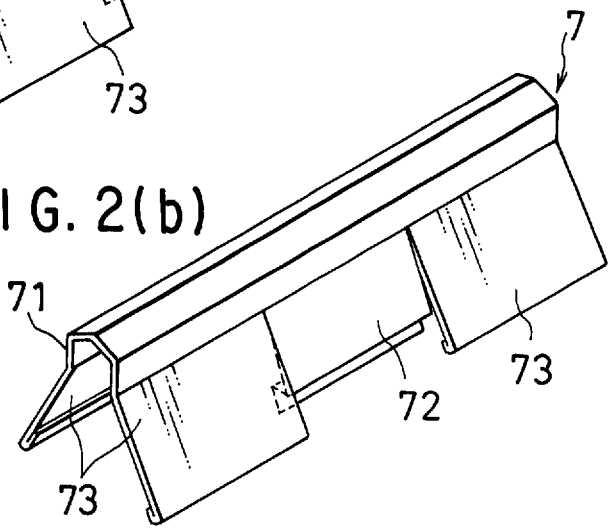
Figure 2C:
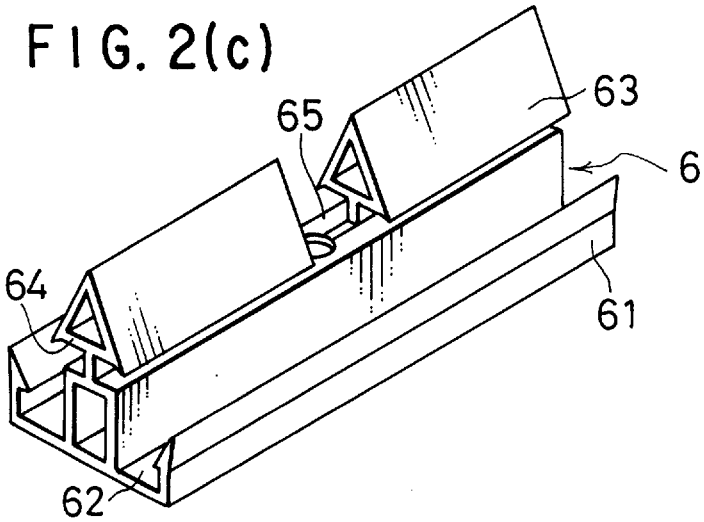

FIG. 1 shows longitudinal facing or longitudinal roofing (hereinafter referred to simply as "facing") 1 according to an embodiment of the present invention. The facing 1 comprises a center face plate 11 having an inner riser 12 at each side. On the outer side of the inner riser 12 is an outer riser 14; a drain channel 13 is formed between the inner and outer risers 12 and 14. Each outer riser 14 has an engaging portion 141 for resiliently engaging with a retainer 6 (FIG. 2 (*c*)). The facing 1 of FIG. 1 and retainers 6 and 7 shown in FIG. 2 are used to form the facing structure shown in FIG. 3.

The facing 1 may be constituted of a known metal material such as a decorative steel sheet, laminated steel sheet, plated steel sheet, stainless steel sheet, aluminum alloy sheet, titanium alloy sheet, copper sheet, brass sheet or lead sheet, or of laminated sheets of carbon fiber or a hard resin board or the like. If sheet metal is used it can be rolled to shape or press formed, or a combination of both processes used. Molding to shape is the main process used in the case of a non-metallic material. While there is no particular limitation on the thickness of the material, it will range from about 0.4 to 1.6 mm.

In this embodiment the face plate 11 is formed in the vicinity of a neutral axis (not shown). The inner riser 12 is substantially perpendicular, and is formed by bending the side of the face plate 11 upward and bending the upper edge down toward the outside, thus forming a space 121 on the underside that is closed on the topside. Thus, the space 121 is narrow at the top and wide at the base.

The outer riser 14 is angled upward and outward, has an inwardly stepped engaging portion 141 midway along, and an end that is bent over inwards. The engaging portion 141 also functions as a cap retainer, described later. Backing material 15 of polyethylene or the like is provided along the underside of the face plate 11 and in the spaces 121. The backing 15 serves to prevent condensation and as sound insulation.

The handling involved in the production and shipping of the facing 1 can be facilitated by arranging the facing 1 in stacks. This also increases the number of facings 1 that can be shipped per unit volume, thereby enabling shipping efficiency to be improved and shipping costs reduced. Here, retainers are each comprised of a lower retainer 6 and an upper retainer 7. However, as described below with reference to other embodiments, retainers may instead be formed as a single integrated member. The lower retainer 6 shown in FIG. 2 (*c*) comprises an upright portion 61 extending upward from each side, and an engaging portion 64 for engaging with the engaging portion 141 of the facing 1. The upper retainer 7 shown in FIGS. 2 (*a*) and 2 (*b*) is comprised of a retaining portion 72 for holding the upper half of the outer risers 14, and a cap retainer 73. The upper retainer 7 shown in FIG. 2 (*a*) or FIG. 2 (*b*) and the lower retainer 6 shown in FIG. 2 (*c*) are used with the facing 1 shown in FIG. 1 to produce the facing structure of FIG. 3.

The lower retainer 6 is constituted to hold the facing 1 and to perform the basic function of the facing structure of the invention. As such, the lower retainer 6 can be regarded as a single retaining member, and the upper retainer 7 as a separate, cap retaining member. The lower retainer 6 may be formed by extrusion of hard resin or aluminum, or press-formed of a plated steel sheet or stainless steel sheet, ceramics or the like, in short or long sections. The upper retainer 7 is formed by rolling or pressing of an ordinary steel sheet.

Figure 3:
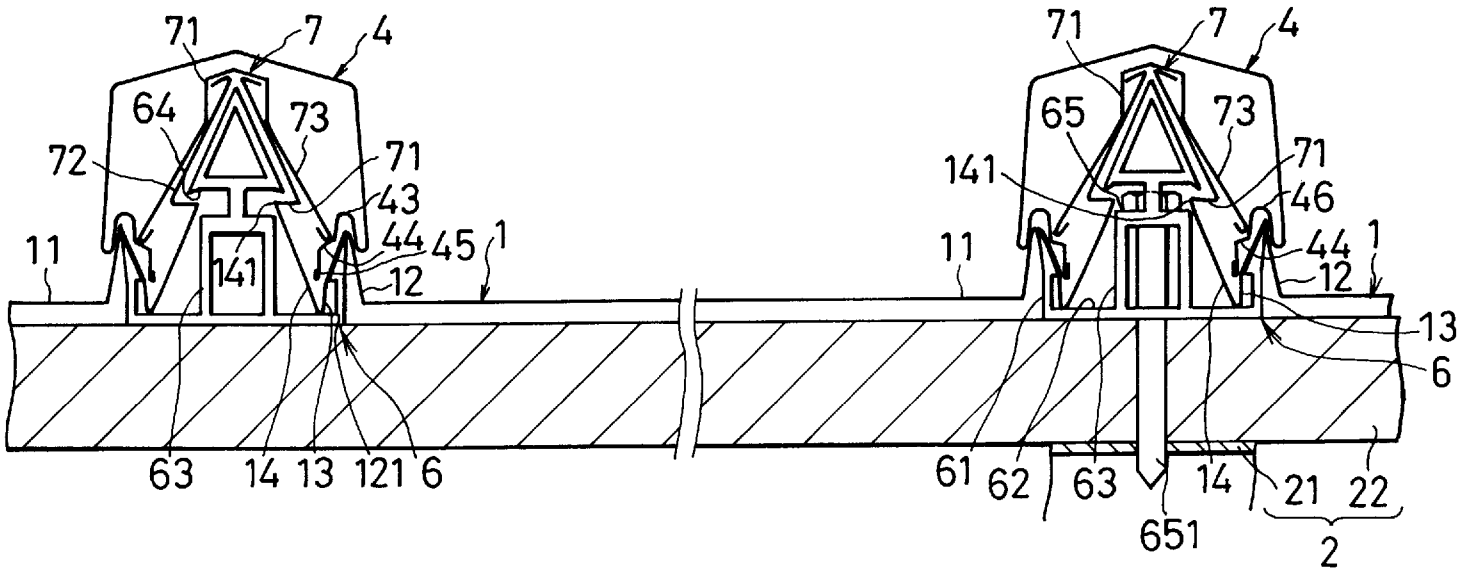
FIG. 3 is a cross-sectional view of a facing structure formed by assembling the facing of FIG. 1, the upper retainer of FIG. 2 (*a*) or 2 (*b*) and the lower retainer of FIG. 2 (*c*)

In this embodiment, the lower retainer 6 has a flat portion 62 along the inner side of each upright portion 61, and further inward an elevated portion 63 extending upward from the flat portion 62. A wedge-shaped engaging portion 64 is formed midway up along each side of the elevated portion 63. Part of the way along the elevated portion 63, there is a cutaway portion (in the substantially triangular part formed by the top and sides) for an anchor portion 65 to a facing base 2 (FIG. 3). In the unassembled state, the angle of inclination of the top of the elevated portion 63 is greater than the outward angle of the outer riser 14.

The upper retainer 7 has a cover portion 71 shaped like a reversed "U" that opens out toward the lower end, a pair of retaining portions 72 having stepped lower edges, and a pair of cap retainers 73 splayed out at a wider angle than the retaining portions 72. As shown in FIG. 2 (*a*), the cap retainers 73 may be set in the center of the upper retainer 7 flanked by the retaining portions 72, or, as shown in FIG. 2 (*b*), the retaining portions 72 may be disposed in the center, flanked by a cap retainer 73 on each side.

Parts in the facing structure shown in FIG. 3 other than the facing 1 and retainers 6 and 7 will now be described. The facing base 2 may be formed of wood, steel, concrete or any other suitable building material so that it can be fastened with nails, screws, anchor bolts or the like. If required, cement excelsior board or other types of board may be laid on the facing base for heat insulation or other purposes.

Capping 4 (see FIG. 6) used in the structure shown in FIG. 3 is shaped into portions 41 that slope down from the apex on each side, and portions 42 that extend vertically down from the edges of the sloping portions 41. The lower edge of each vertical portion 42 is bent inward to form a channel 43 open at the lower end, a stepped stop 44, and a downward-extending insertion portion 45. Although the capping 4 is usually formed of the same material as the facing 1, it may instead be formed of aluminum or extruded resin. While the thickness is not especially defined, when it is formed by extrusion it is usually around 1.2 to 2.5 mm thick.

With respect to the facing structure of FIG. 3 thus formed of the above-described component members, lower retainers 6 are arranged at a prescribed spacing on the facing base 2 having a heat insulation board 22 laid on structural frame members 21, and anchored in place by fasteners 651. Facing 1 is then laid and fixed between adjacent lower retainers 6. To complete the structure, upper retainers 7 are fitted between adjacent facings 1, followed by the cappings 4.

The facing 1 is laid with an upright portion 61 of the lower retainers 6 inserted into a space 121, an engaging portion 141 resiliently engaged with a wedge shaped portion 64 and the upper part of the outer riser 14 set up against the elevated portion 63. There is a space between the face plate 11 and the facing base 2. The upper retainer 7 is attached by positioning the retainer 7 with the cover portion 71 aligned over the space between the edges of adjacent facings 1 and the lower inside edges of the retaining portions 72 in resilient engagement with the underside of the engaging portion 141 of the outer riser 14. Thus, in addition to holding the outer risers 14, the retaining portions 72 form a link with the lower retainers 6.

The capping 4 is fitted by pressing it down onto the upper retainer 7 so that the cap retainers 73 are flexed downward by the insertion portions 45 and the upper edge of the inner riser 12 locates in the channel 43, producing a resilient engagement with the cap retainers 73 in abutment with the stops 44. This facing structure provides high weathering performance, since even if rainwater does manage to penetrate beyond the inner riser 12, it is drained off along the drain channel 13. Moreover, because the facing 1 is laid on lower retainers 6 anchored in place beforehand across the facing base 2 and the engaging portion 141 is held toward the facing base 2 in a resilient engagement with wedge-shaped portion 64, no positional adjustment is required after the facing 1 has been laid. Also, the facing 1 is held very strongly by the lower retainers 6, so workability is high, and during the facing work there is a high safety factor with respect to gusts of wind and the like.

Thus, the facing structure of the invention provides a high degree of balance among workability, weathering performance and worker safety, and also takes into account the rising overall awareness relating to safety such as can be seen in the Product Liability Regulations recently enforced in Japan. The good weathering performance, elimination of the need for positional adjustment, high workability and high safety are obtained from the basic constitution of the invention, and are therefore also provided by the other embodiments described below.

In particular, the characteristics possessed by the facing structure of FIG. 3 impart the following effects.

Lateral movement of inner risers 12 is suppressed by the upright portions 61, providing excellent resistance to upward wind pressure (negative load) and snow load (positive load). Deformation of the inner risers 12 is also prevented, thereby preventing the degradation of weathering performance that would result from such deformation. Stable holding of the outer risers 14 by the retaining portions 72 provides a further strengthening of the attachment of the facing 1 and high workability. Also, the addition of the stabilizing effect of the upright portions 61, described above, improves both positional control and deformation prevention.

Compared to the case where cap holders are provided on the facing 1, providing the cap retainers 73 on the upper retainer 7 enhances precision of both product and execution, and ensures the capping 4 is held more securely. Providing the capping 4 with channels 43 to take the inner risers 12 helps to prevent the capping 4 being deformed by the various loads to which it is subjected, and also reduces such loads. Like the retaining portions 72, the channels 43 also serve to hold the facing 1 toward the facing base 2.

Even though the heat of the sun can result in expansion of the face plate 11, the expansion can be absorbed by the space 121 on the underside of each inner riser 12, preventing or reducing warping. Moreover, having the face plate 11 higher than the drain channel 13 creates a space between the face plate 11 and the facing base 2, so that even if the face plate 11 becomes very hot, it is unnecessary to effect conventional thermal bonding with an asphalt waterproofing sheet for the purpose of hampering the expansion.

In contrast to the type of known cap stop means, such as types that have to be spread to fit into position with respect to an engaging portion formed on a riser, the action to stop the capping 4 is readily attained simply by inserting the stepped stop portion 44 into the space between the inner risers 12 and the cap retainers 73. This engagement is powerful and minimizes rattling of the capping 4. The facing 1 can be in the form of long sections running in the direction of construction work execution. When used in standard sized pieces, ranging from around 3 to 8 meters, a double layer connecting portion 16 is provided at each upper end that is lower than the normal surface level, as shown in FIG. 4, so that, as shown in FIG. 5, adjoining facings 1 form a virtually single surface, providing good weathering performance and good appearance.

Figure 4:
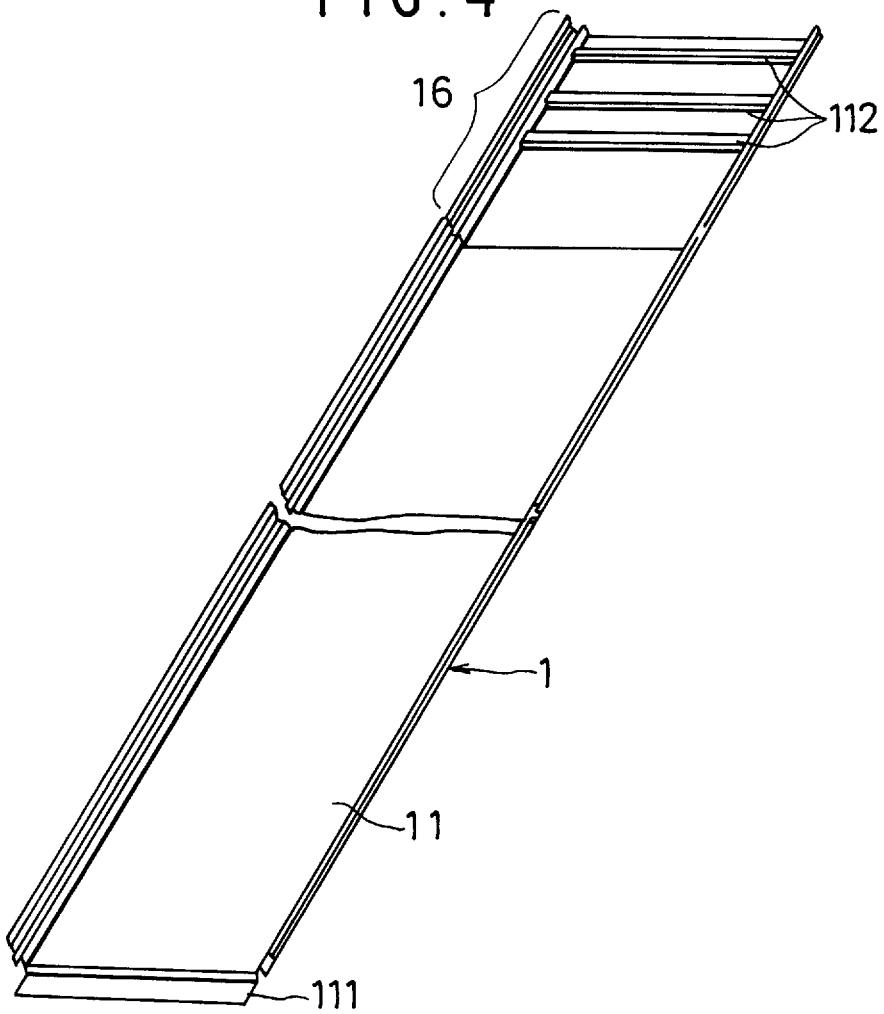
FIG. 4 is a perspective view of another embodiment of the facing.
Figure 5:
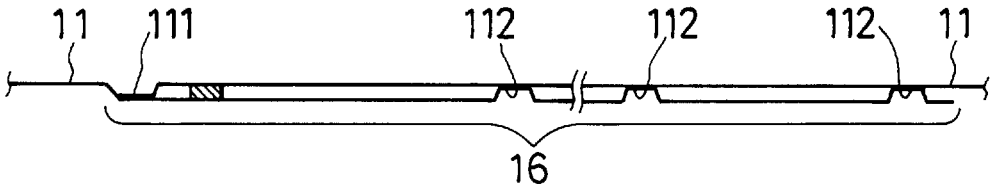
FIG. 5 is a side cross-sectional view of a double-layer portion of the facing of FIG. 4.

With reference to FIG. 4, for example, the downstream ends of standard size sheets of facing 1 are each provided with a stepped-down portion to form an abutment portion 111 extending toward the eaves side. When the facing is laid, the abutment portion 111 abuts against the face plate 11 at the location of the connecting portion 16 of adjacent facing 1. The face plate 11 is equipped with three ribs 112 at the position of the connecting portion 16, the ribs being in contact with the underside of the face plate 11 where adjacent facing 1 is located on the upper side. The shallow spaces thus formed prevent intrusion of water through capillary action, and also serve to block any water that does manage to penetrate.

Figure 6:
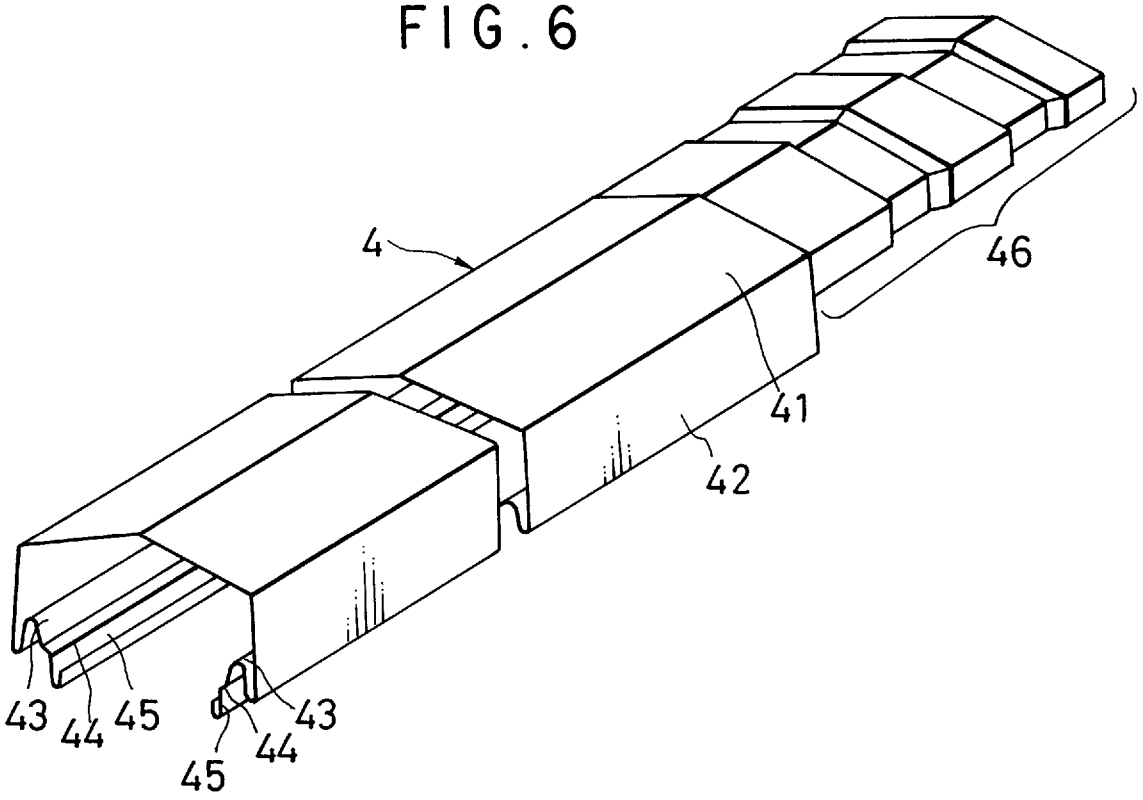
FIG. 6 is a perspective view of a capping used for the facing structure shown in FIG. 3.
Figure 7:
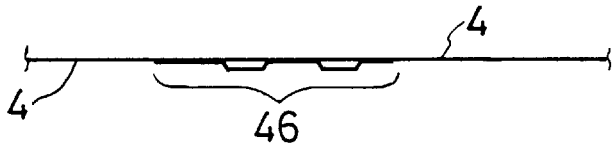
FIG. 7 is a side cross-sectional view of a double-layer portion of the capping of FIG. 6.

Thus, the facing 1 of the invention can be prepared in standard sizes that can be laid by a single worker. That is, on the site, facing 1 in standard lengths of around 5 m can be safely and securely transported, laid and attached to the facing base by a single worker. Face plates 11 can be readily connected together, so the appearance is also good. The capping 4 can also be in the form of long sections running in the direction of construction work execution. When used in standard lengths, as shown in FIG. 6, a double layer cap connecting portion 46 is provided at each upper end that is lower than the normal surface level, so that as shown in FIG. 7, adjoining cap sections form a virtually single surface, which provides good weathering performance and good appearance.

The cap connecting portion 46 is comprised of raised portions that are in contact with the underside of an adjacent capping 4 and concave portions not in contact, when the cap connecting portion 46 is installed in position. The concave portions prevent the intrusion of water through capillary action, and are also charged with sealant to provide a physical barrier to the entry of water. The structures illustrated in FIGS. 8 to 11 are fundamentally the same as the one shown in FIG. 3, and therefore provide the same good weathering performance, elimination of the need for positional adjustment, high workability and high safety effects as the FIG. 3 structure.

In the structures of FIGS. 8 to 11, the upright portions 61 of the lower retainers 6 locate in spaces 121 (see FIG. 1), outer risers 14 are held by retaining portions 72, the upper retainer 7 is provided with cap retainers 73 for resiliently engaging with capping 4 (attachment portions 47), the cap channel 43 accommodates the upper edge of the inner riser 12, and a space is formed between the face plate 11 and the facing base 2 (FIG. 3). These component configurations therefore impart the same resistance to various loads and to deformation, strengthened attachment of the facing 1, high workability, improved positional control, enhanced product and execution precision, and prevention of heat warping already described in detail in the foregoing. With reference to the drawings, parts that are the same have been given identical reference numerals, and further explanation thereof is omitted. This also applies to the structures shown in FIG. 12 onwards.

Figure 8:
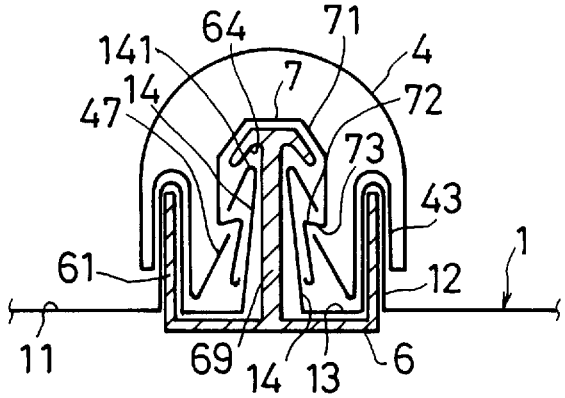
FIG. 8 is a cross-sectional view of another embodiment of the facing structure.

In the embodiment of the invention shown in FIG. 8, engaging portion 141 is at the upper end of the outer riser 14. The portion 64 with which the portion 141 resiliently engages is an angled portion formed at each side of the upper end of a central upright portion 69. When the upper retainer 7 is in the form of long sections extending along the direction in which construction is implemented, the cover portion 71 is aligned between the edges of adjacent facings 1 in an arrangement that, with the addition of the capping 4 on the outside, provides a secondary water-proofing configuration and a further enhancement of the weathering performance.

Figure 9:
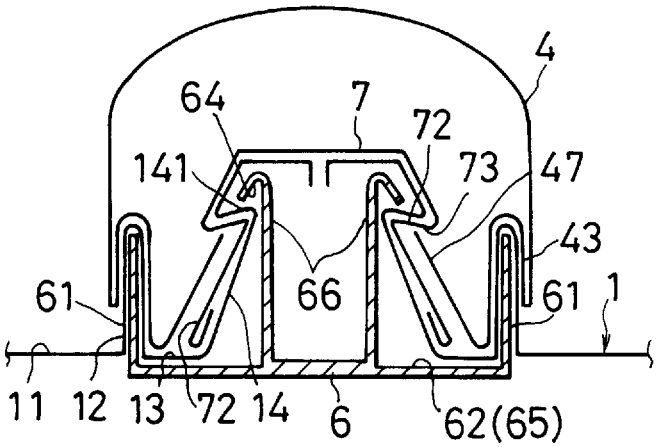
FIG. 9 is a cross-sectional view of another embodiment of the facing structure.

In another embodiment shown in FIG. 9, the engaging portion 64 is an angled portion formed on an outside part of the upper end of each of two upright portions 66. Using an upper retainer 7 formed of long sections provides the same enhanced water-proofing and weathering performance described with reference to the arrangement of FIG. 8. As in the other embodiments, the engaging portion 141 of this embodiment is held by the upper retainer 7. However, this embodiment has an additional retaining portion 72 disposed above the drain channel 13, meaning the upper retainer 7 is held toward the facing base 2 by a multiplicity of retaining portions 72, further strengthening the attachment of the facing 1 and improving the workability.

With respect to the structure of this embodiment, using a lower retainer 6 formed in long sections creates a drainage space between the upright portions 66 on which the ends of the outer risers 14 front. Thus, any water that penetrates into the space between facings 1 can be drained along that drainage space. As it also functions to provide the facing 1 with secondary protection against water, the weathering performance is very high. Compared to the use of short sections, positional control is also higher. The space between upright portions 61 and 69 can be used as an anchor site, or an anchor site can be extended out past the upright portions 61, or anchoring can be effected by using bonding adhesive applied to the underside. When the ends of the outer riser 14 do not go over the upright portions 66, the space between the upright portions 66 is used as the anchor site and the space between upright portions 61 and 66 is used for drainage. That is, the anchor site and drainage spaces may be provided according to the configuration of the facing 1.

Figure 10:
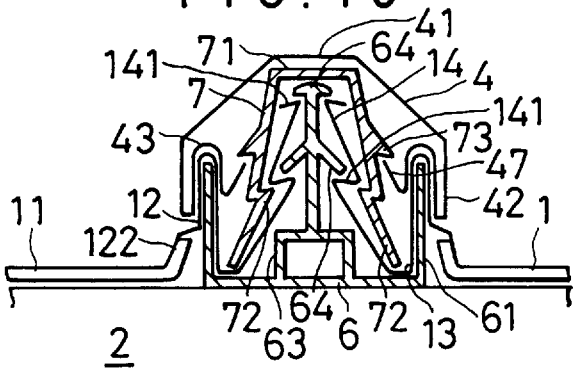
FIG. 10 is a cross-sectional view of another embodiment of the facing structure.

FIG. 10 shows another embodiment of the facing structure of the invention. In this embodiment an engaging portion 141 is provided in two places, in the middle and at the end of the outer riser 14, and there are two angled portions 64 engaged by the engaging portions 141, one midway up the elevated portion 63, and the other at the top. Since the lower retainer 6 therefore holds the facing 1 toward the facing base 2 at two points, once the facing is installed, it does not need to be repositioned and it is held securely in place, making it safer to work with in windy conditions. The fact that this structure also has multiple retaining portions 72 holding the facing 1 (outer riser 14 and drain channel 13) provides a further increase in the strength with which the facing 1 is attached, and positioning and deformation control are also improved.

Moreover, the inner surface of the inner riser 12 has a stepped portion 122 that widens toward the lower end. The stepped portion 122 is provided at a height that is greater than the depth of the wetted perimeter of the facing 1, but below the lower edge of the capping 4. This arrangement makes it possible to prevent rainwater seeping in through capillary action at points of contact between the capping 4 and the inner risers 12. In flow calculations, the wetted perimeter refers to the area of an object in contact with the water. The smooth transition between the capping 4 and the inner riser 12 improves the appearance of ledge-shaped portions and reduces the amount of wind and rain coming in along the line of the ridge pole via the above points of contact. Space for expansion is increased. In this embodiment the upper and lower retainers 7 and 6 are both extrusion formed of the same material. The capping 4 is supported from the reverse side by the top of the cover portion 71, which enables the structure to better withstand positive loads.

Figure 11:
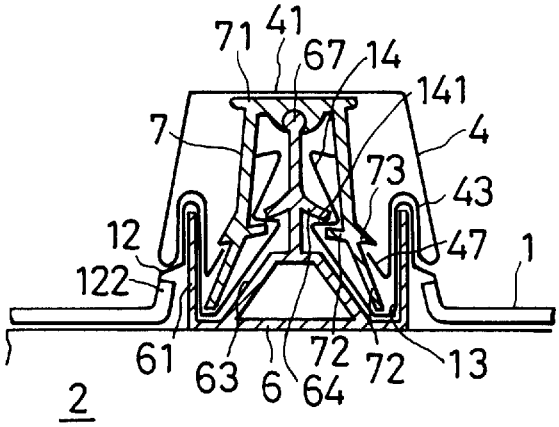
FIG. 11 is a cross-sectional view of another embodiment of the facing structure.

FIG. 11 shows a facing structure according to another embodiment. This embodiment also has multiple retaining portions 72 holding the facing 1 (outer riser 14 and drain channel 13) down toward the facing base 2, and therefore also provides a further increase in the strength with which the facing 1 is attached, and improved positioning and deformation control. Since the inner surface of the inner riser 12 also has a stepped portion 122, the same effect is obtained, that of preventing entry of water by capillary action at points of contact between the capping 4 and the inner risers 12. In this case too, the capping 4 is supported from the reverse side by the top of the cover portion 71, so this structure too is better able to withstand positive loads. As in the other embodiments, the retaining portions 72 that maintain the outer risers 14 in this embodiment also provides the connection with the lower retainer 6. In this case, a round connecting portion 67 provided at the top of the elevated portion 63 is set into engagement with the underside of the cover portion 71 of the upper retainer 7. This configuration provides good resistance to negative loads.

Figure 12:
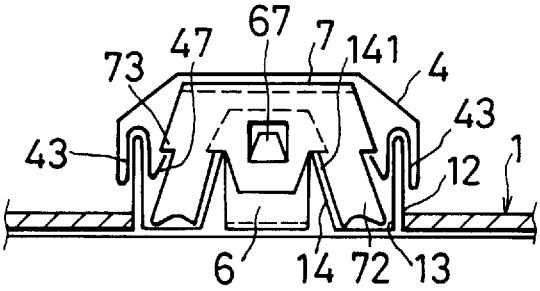
FIG. 12 is a cross-sectional view of another embodiment of the facing structure.

FIG. 12 shows another embodiment of the facing structure. In this embodiment, the lower retainer 6 and upper retainer 7 are formed by rolling and pressing steel sheet, and have a longitudinal weld 67. The entire facing structure, including the capping 4, is formed of the same material as the facing 1, facilitating quality control.

Figure 13:
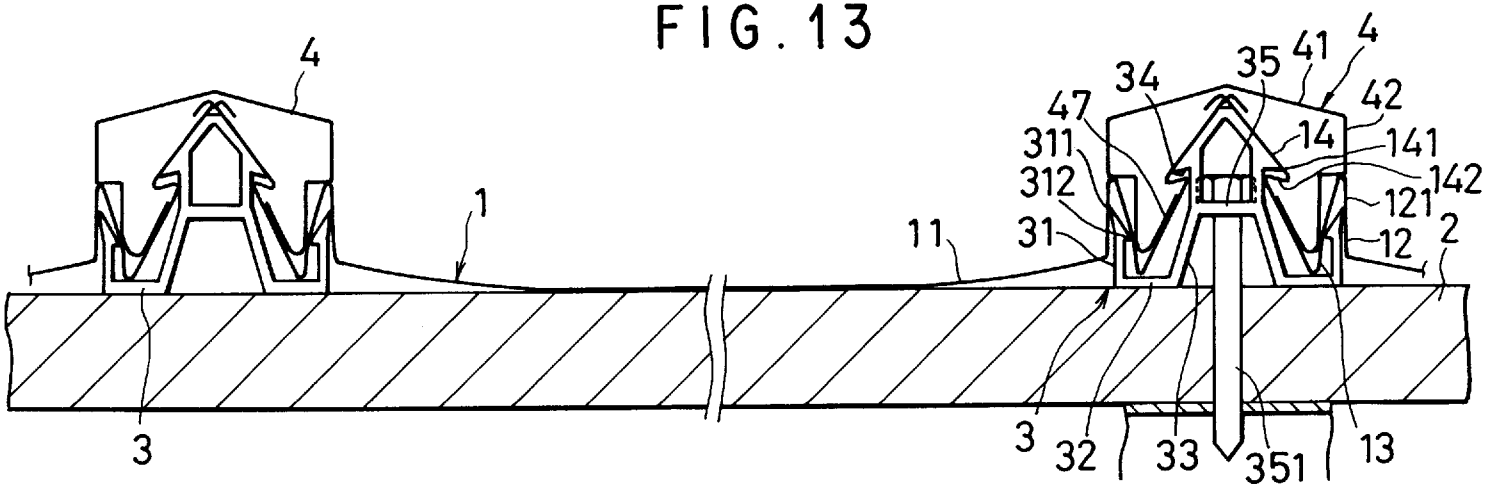
FIG. 13 is a cross-sectional view of another embodiment of the facing structure.

In each of the embodiments shown in FIG. 13 onwards the retainer is formed in one piece. In each case the basic configuration is the same as that of the embodiments described above, so parts having the same function as parts described above with reference to lower retainer 6 have been given the same reference numerals. The parts of the one-piece retainer 3 are upright portion 31, specification part 311, second engaging portion 312, flat portion 32, elevated portion 33, engaging portion 34, and anchor portion 35 (anchor 351).

In the embodiment shown in FIG. 13, at the reverse side of engaging portion 141 is cap retainer 142 that engages with attachment portion 47 of the capping 4. In this embodiment upright portions 31 locate in the space 121 on the reverse side of the inner riser 12. As described above, this suppresses lateral movement of the inner risers 31, imparting improved resistance to negative and positive loads, and by also suppressing deformation of the risers, prevents degradation of weathering performance that such deformation would result in. The central part of the face plate 11 is concave. This gives improved resistance to wind pressure, prevents occurrence of a "pocket wave" phenomenon, and exhibits good appearance.

In the embodiment shown in FIG. 14, again the reverse side of the engaging portion 141 serves as a cap retainer 142 that engages with the attachment portion 47 of the capping 4. In the case of this embodiment, the facing 1 is laid with the leading edges of the outer risers 14 of adjacent facings 1 close together and covered with a waterproofing tape 100. By facilitating secondary waterproofing, this improves the weathering performance.

Figure 15:
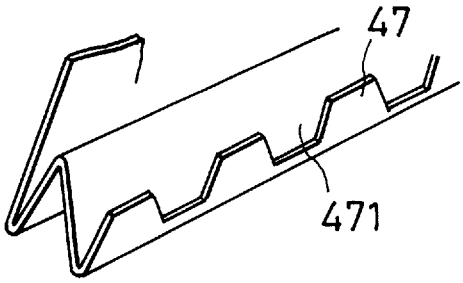
FIG. 15 is a perspective view showing part of an engaging edge of the capping provided with cutouts.
Figure 16:
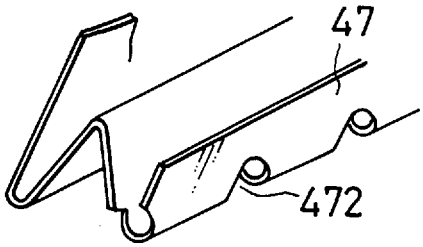
FIG. 16 is a perspective view showing part of the engaging bend of the capping provided with cutouts.
Figure 17A:
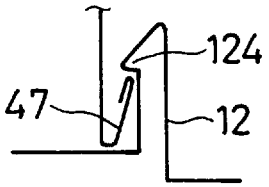
FIG. 17 (*a*) is a front view showing the arrangement of an engagement of the capping with an inner riser portion of the facing.
Figure 17B:
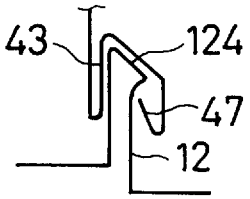
Figure 17C:
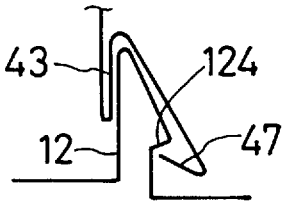
Figure 17D:
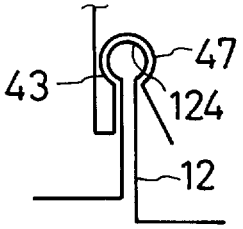

In each of the embodiments shown in FIGS. 8 to 14, the attachment portion 47 is curved back into the capping 4. However, by providing cutouts 471 along the engaging edge of the attachment portion 47 as shown in FIG. 15, or cutouts 472 along the bend of the attachment portion 47 as shown in FIG. 16, if a design requires that the thickness of the facing 1 be increased or the curvature decreased, the cutout arrangements ensure that stable engagement of the capping 4 is maintained. When parts to be engaged are long and thick, increased force is needed to effect resilient engagement. This can result in an incomplete engagement, or even an engagement that is incomplete but is wrongly thought to be complete. Even when engagement is between thin parts, the need to form surfaces into bends with a small curvature can result in engaging edges that are deformed by stresses and therefore unable to effect full or secure engagement.

Figure 14:
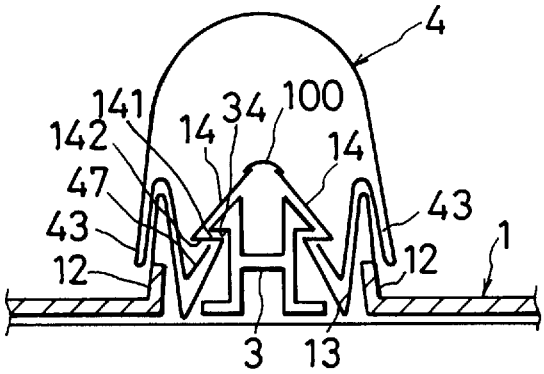
FIG. 14 is a cross-sectional view of another embodiment of the facing structure.
Figure 18:
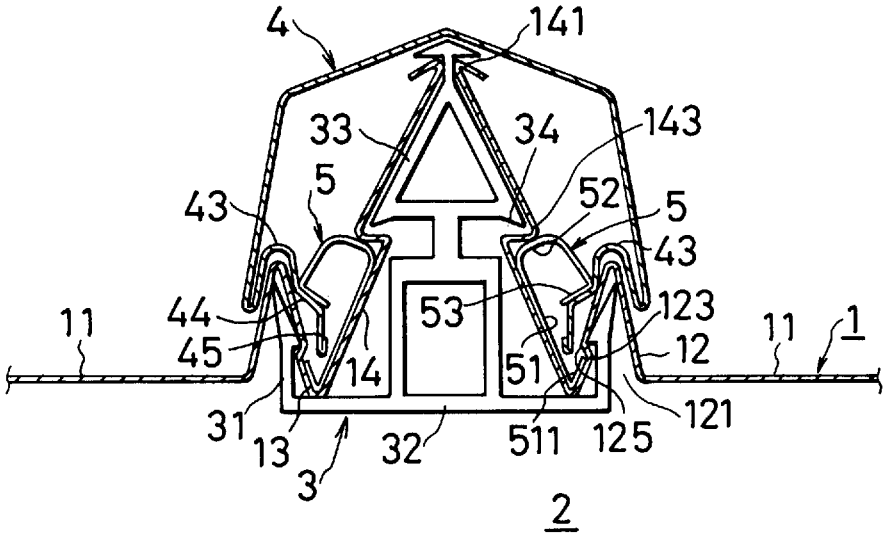
FIG. 18 is a cross-sectional view of another embodiment of the facing structure.

While the outer risers 14 have the cap retainers 142 in the facing structures shown in FIGS. 13 and 14, a cap retainers 124 may instead be provided on the inner risers 12, as shown in FIGS. 17 (*a*) to 17 (*d*). In further embodiments shown in FIGS. 18 and 19, the capping 4 is resiliently held by a retainer 3 and a separate cap retainer 5. The cap retainer 5 fits between the inner and outer risers 12 and 14, is formed of the same material as the facing 1 or capping 4, and is usually produced in short lengths. The cap retainer 5 is a frame-shaped part with a brace 51 that fits along the lower part of the outer riser 14, a holder 52 in engagement with the rear face of the portion 141 (engaging portion 143), and a spreader 53 that resiliently presses against the stop 44. The cap retainer 5 is fitted into place by aligning it so that the brace 51 is located along the lower part of the outer riser 14 and the lower edge abuts against the drain channel 13, at which point the holder 52 is resiliently supported by the engaging portion 143. The insertion portion 45 of the capping 4 is then inserted into the space between the spreader 53 and the inner riser 12, whereby the capping 4 is held stably with the spreader 53 against the stop 44.

With the configuration of this structure, the cap retainer 5 fits between the outer risers 14 and the inner risers 12. Compared with the embodiments using a single-piece component such as upper retainer 7, this arrangement has a smaller component profile, which reduces costs, and it is also safer, as one cap retainer is installed per sheet of facing 1. In particular, the lower edge of the brace 51 is turned up to form a second holder 511 that is supported by engagement with the reverse side of a second engaging portion 123 on the inner riser 12 (second engaging portion 125), ensuring the stable installation of the cap retainer 5 and increased stability of the capping 4. In this structural configuration, an engaging portion 141 is provided at two points on each outer riser 14, and the inner riser 12 also has the second engaging portion 123, so the facing 1 is held toward the facing base 2 by the retainer 3 at a total of three points. As described with respect to a previous embodiment, this means that no positional adjustment is required after the facing has been laid, and because the facing 1 is held even more strongly, the work is even safer and less affected by gusts of wind.

Figure 19:
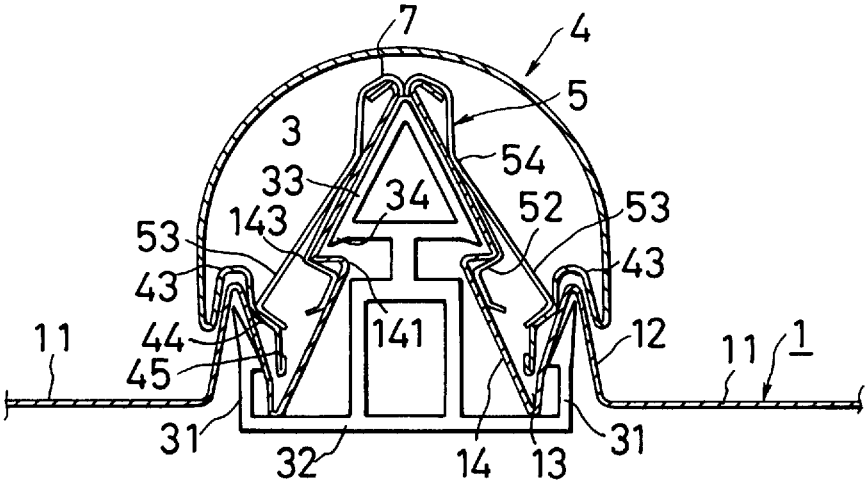
FIG. 19 is a cross-sectional view of another embodiment of the facing structure.

The only difference between the facing structure shown in FIG. 19 and that shown in FIG. 3 is that in the configuration of FIG. 19 the upper retainer 7 is divided down the middle and the upper end of the outer riser 14 is contained within the edge of the division. While, as described above, the cap retainer 5 may be regarded as an upper retainer comprised of a plurality of members, here it will be described as a cap retainer 5 installed between the inner riser 12 and the outer riser 14. The cap retainer 5 has a portion 54 that extends down over the outer riser 14. The lower end of the extended portion 54 has a curved portion that constitutes a holder portion 52 supported by each engaging portion 143. Part of the extended portion 54 is divided lengthwise, and an end of this divided portion is formed into a spreader portion 53 in resilient engagement with the capping 4. In the case of this configuration, the cap retainer 5 is installed from above. Compared to the cap retainer 5 of FIG. 18, laying the facing 1 in small sections has no adverse effect on the efficiency of the installation operation. Furthermore, the arrangement of FIG. 19 allows plenty of room for added functions, such as bindings to prevent a capping from moving out of alignment, when a standard size capping is used.

While the embodiments of the invention have been described in the foregoing with reference to the drawings, it is to be understood that the invention is not limited to the arrangements of the above embodiments. Instead, the invention can be embodied in any way that does not depart from the composition of the invention as defined in the claims. Thus, although asphalt roofing, asphalt felt or other such known waterproof materials are not illustrated in the drawings of the embodiments, this does not preclude the use thereof. When fiber-based heat insulation or the like is laid on the facing base, it is preferable that the above materials be cured prior to use.

The longitudinal facing according to this invention offers good weathering performance, since any rain that gets past the inner riser can be easily run off to the eaves along the drainage channel provided on the outer side of the inner riser. Retainers are fixed to the facing base beforehand and outer risers are set into resilient engagement with the retainers, so the position of the facing does not have to adjusted after it is laid. Moreover, because the facing is held very securely by the retainers, facing can be laid efficiently, and with a good level of safety even in windy conditions. Thus, the facing structure of the invention provides a high degree of balance among workability, weathering performance and worker safety, and also takes into account the rising overall awareness relating to safety such as can be seen in the Product Liability Regulations.

Retainers have upright portions or elevated portions that fit into spaces on the reverse side of inner risers on the facing, thereby suppressing lateral movement of the risers. This imparts excellent resistance to negative loads generated by upward wind pressure, and positive loads such as snow, and by also suppressing deformation of the inner risers, prevents the deterioration in weathering performance that such deformation would cause. The strength of the facing bond can be enhanced and workability improved by causing upper retainers to retain with inner risers, their inside root portions, drainage channels, or outer risers.

Capping can be securely maintained by resilient engagement with cap retainers provided on upper retainers, enhancing precision of both product and execution and ensuring the capping is held on more securely. Providing the capping with channels into which the inner risers locate helps to prevent deformation of the capping subjected to various loads, and also reduces such loads. Providing a cap retainer between the inner and outer risers can decrease costs compared with arrangements using one-piece cap retainers, owing to the fact that the shape profile is smaller. It is also increases efficiency, as one cap retainer is installed for each sheet of facing.

What is claimed is:

1. Longitudinal facing laid on a base between retainers at a prescribed spacing, the facing comprising:

a central face plate having a central portion;

a right side inner riser separated from a left side inner riser by the central portion;

an outer riser on the right side and the left side of the central portion and spaced further from the central portion than each inner riser in a direction parallel to a surface of the base;

a drain channel formed between the inner and outer risers;

an engaging portion at at least one of an end portion and a median portion of each outer riser in resilient engagement with each of the retainers.

2. A retainer for retaining on a facing base longitudinal facing, the facing including a central face plate having a central portion, a right side inner riser separated from a left side inner riser by the central portion, an outer riser on the right side and the left side of the central portion and spaced further from the central portion than each inner riser in a direction parallel to a surface of the facing base, and a drain channel formed between the inner and outer risers, said retainer comprising at least one lower retainer portion that is configured to be disposed beforehand on the facing base and includes an upright portion that engages with an inner riser of the facing, and at least one upper retainer portion that is configured to retain at least one of the inner riser, an inside root portion thereof, the drain channel, and the outer riser and includes a cap retainer part that is configured to resiliently hold a cap disposed to cover a gap between adjacent facings.

3. A facing structure comprising:

retainers disposed at a prescribed spacing on a facing base on which a building body or roof sheathing has been laid with sheets of longitudinal facing laid and fixed between adjacent retainers and caps provided over spaces between adjacent sheets of facing wherein the facing comprises, a central face plate having a central portion, an inner riser on a right side of the central portion and on a left side of the central portion, an outer riser on the right side and the left side of the central portion and spaced further from the central portion than each inner riser in a direction parallel to a surface of the facing base, and a drain channel formed between the inner and outer risers; and wherein the outer riser of the facing has an engaging portion at at least one of top and median portions thereof, the retainer has an engagement portion, and the engaging and engagement portions are resiliently engaged to maintain the facing on the facing base.

4. The facing structure according to claim 3, wherein each retainer comprises at least one lower retainer portion containing the engagement portion, said lower retainer portion being configured to be disposed beforehand on the facing base and at least one upper retainer portion, said upper retainer portion being configured to retain at least one of the inner riser, and inside root portion thereof, the drain channel, and the outer riser.

5. The facing structure according to claim 4, wherein each retainer comprises at least one lower retainer portion containing the engagement portion, said lower retainer portion being configured to be disposed beforehand on the facing base and an upper retainer portion having a cap retainer part configured to resiliently engage with one of the caps through attachment portions at each side of each cap.

6. The facing structure according to claim 5, wherein the caps have a concave portion for accommodating an inner riser.

7. The facing structure according to claim 4, wherein the caps have a concave portion for accommodating an inner riser.

8. The facing structure according to claim 3, wherein each retainer comprises at least one lower retainer portion containing the engagement portion, said lower retainer portion being configured to be disposed beforehand on the facing base and an upper retainer portion having a cap retainer part configured to resiliently engage with one of the caps through attachment portions at each side of each cap.

9. The facing structure according to claim 8, wherein the caps have a concave portion for accommodating an inner riser.

10. The facing structure according to claim 3, wherein a cap retainer is provided between the inner and outer risers of the facing that resiliently holds the caps, and the cap retainer is supported by engagement with at least an engaging portion provided partway up an outer riser of the facing.

11. The facing structure according to claim 10, wherein the cap retainer has an extended portion extending up along the outer riser.

12. The facing structure according to claim 11, wherein the caps have a concave portion for accommodating an inner riser.

13. The facing structure according to claim 10, wherein the caps have a concave portion for accommodating an inner riser.

14. The facing structure according to claim 3, wherein the caps have a concave portion for accommodating an inner riser.

15. A facing structure comprising retainers disposed at a prescribed spacing on a facing base on which a building body or roof sheathing has been laid with sheets of facing laid and fixed between adjacent retainers and caps provided over spaces between adjacent sheets of facing wherein each retainer has an upright portion and the facing comprises, a central face place having a central portion, a right side inner riser separated from a left side inner riser by the central portion, an outer riser on the right side and left side of the central portion and spaced further from the central portion than each inner riser in a direction parallel to a surface of the facing base, and a drain channel formed between the inner and outer risers; and wherein the upright portion on each retainer is located in a space having a closed topside formed at a reverse side part of each inner riser to control lateral movement of the facing when a load is imposed on the facing.

16. The facing structure according to claim 15, wherein each retainer comprises at least one lower retainer portion containing the engagement portion, said lower retainer portion being configured to be disposed beforehand on the facing base and at least one upper retainer portion, said upper retainer portion being configured to retain at least one of the inner riser, an inside root portion thereof, the drain channel, and the outer riser.

17. The facing structure according to claim 16, wherein each retainer comprises at least one lower retainer portion containing the engagement retainer portion, said lower portion being configured to be disposed beforehand on the facing base and an upper retainer portion having a cap retainer part configured to resiliently engage with one of the caps through attachment portions at each side of each cap.

18. The facing structure according to claim 17, wherein the caps have a concave portion for accommodating an inner riser.

19. The facing structure according to claim 16, wherein the caps have a concave portion for accommodating an inner riser.

20. The facing structure according to claim 15, wherein each retainer comprises at least one lower retainer portion containing the engagement portion, said lower retainer portion being configured to be disposed beforehand on the facing base and an upper retainer portion having a cap retainer part configured to resiliently engage with one of the caps through attachment portions at each side of each cap.

21. The facing structure according to claim 20, wherein the caps have a concave portion for accommodating an inner riser.

22. The facing structure according to claim 15, wherein a cap retainer is provided between the inner and outer risers of the facing that resiliently holds the caps, and the cap retainer is supported by engagement with at least an engaging portion provided partway up an outer riser of the facing.

23. The facing structure according to claim 22, wherein the cap retainer has an extended portion extending up along the outer riser.

24. The facing structure according to claim 23, wherein the caps have a concave portion for accommodating an inner riser.

25. The facing structure according to claim 22, wherein the caps have a concave portion for accommodating an inner riser.

26. The facing structure according to claim 15, wherein the caps have a concave portion for accommodating an inner riser.

* * * * *